US011432625B1

(12) United States Patent
Freeman

(10) Patent No.: US 11,432,625 B1
(45) Date of Patent: Sep. 6, 2022

(54) MODULAR WALKING STICK ASSEMBLY

(71) Applicant: Olivia Freeman, Bakersfield, CA (US)

(72) Inventor: Olivia Freeman, Bakersfield, CA (US)

( * ) Notice: Subject to any disclaimer, the term of this patent is extended or adjusted under 35 U.S.C. 154(b) by 0 days.

(21) Appl. No.: 17/203,144

(22) Filed: Mar. 16, 2021

(51) Int. Cl.
*A45B 3/04* (2006.01)
*A45B 9/02* (2006.01)
*A45B 9/00* (2006.01)

(52) U.S. Cl.
CPC ..... *A45B 3/04* (2013.01); *A45B 9/02* (2013.01); *A45B 2009/007* (2013.01)

(58) Field of Classification Search
CPC ... A45B 2009/007; A45B 3/04; A63B 21/075; A63B 15/00
See application file for complete search history.

(56) References Cited

U.S. PATENT DOCUMENTS 4,351,348 A * 9/1982 Axton ..... A45B 3/00 135/66
4,664,373 A * 5/1987 Hait ..... A63B 21/072 482/109
4,688,788 A 8/1987 Olufs
D297,887 S 10/1988 Hattersley
5,443,435 A 8/1995 Wilkinson
5,490,825 A * 2/1996 Wilkinson ..... A63B 21/072 482/109
5,586,957 A * 12/1996 Wilkinson ..... A63B 15/00 482/3
5,653,664 A * 8/1997 Jennings ..... A63B 15/00 482/121
5,778,914 A 7/1998 Trani
5,788,608 A * 8/1998 Wilkinson ..... A63C 11/221 482/74
5,876,312 A 3/1999 McClendon
6,131,592 A 10/2000 Panizza
6,745,785 B2 * 6/2004 Kotovsky ..... A45F 3/16 135/65
6,898,824 B2 5/2005 Zaltron
6,913,279 B1 * 7/2005 Opalka ..... A61H 3/00 135/65
8,544,487 B1 * 10/2013 Clinkscales ..... A45B 3/04 135/77
8,985,802 B2 * 3/2015 Nievas ..... A45B 3/02 362/184
10,172,427 B2 * 1/2019 D'Jay ..... B65D 23/001
11,110,314 B1 * 9/2021 Wineman ..... A63B 21/0728
2003/0145881 A1 * 8/2003 Harroun ..... A61H 3/00 135/65

(Continued)

FOREIGN PATENT DOCUMENTS

EP 0820711 1/2002

*Primary Examiner* — Noah Chandler Hawk

(57) ABSTRACT

A modular walking stick assembly includes a walking stick that is elongated for support while walking. A plurality of weighted cylinders is provided and each of the weighted cylinders has a unique weight with respect to each other. Respective ones of the weighted cylinders is attachable to the walking stick to adjust the weight of the walking stick to accommodate a preference of a user. A sleeve is attachable to the walking stick or the weighted cylinder that is attached to the walking stick for gripping. A light emitter is coupled to the sleeve to emit light outwardly therefrom when the light emitter is turned on thereby making the user visible to other individuals.

8 Claims, 5 Drawing Sheets

(56) References Cited

U.S. PATENT DOCUMENTS

| | | | | |
|---|---|---|---|---|
| 2017/0224573 | A1* | 8/2017 | Challa | A45B 9/04 |
| 2018/0177267 | A1* | 6/2018 | D'Jay | A45B 9/02 |
| 2020/0029662 | A1* | 1/2020 | D'Jay | A45B 9/02 |
| 2020/0367618 | A1* | 11/2020 | Daly | A45B 3/04 |

* cited by examiner

MODULAR WALKING STICK ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to walking stick device and more particularly pertains to a new walking stick device for facilitating a user to adjust a length and a weight of a walking stick. The device includes a walking stick and a plurality of weighted cylinders that can be attached to the walking stick. Additionally, the device includes a sleeve that is attachable to the walking stick. A light emitter is coupled to the sleeve for enhancing visibility of the user to observers in a darkened environment.

(2) Description of Related Art Including Information Disclosed Under 37 CFR 1.97 and 1.98

The prior art relates to walking stick devices including a variety of walking sticks that include torus shaped weights that can be positioned around the walking stick for increasing the weight of the walking stick. The prior art also disclose a variety of walking sticks that have weighted modular sections that are attachable to the walking sticks for adjusting the weight of the walking sticks. In no instance does the prior art disclose a modular walking stick that includes weighted cylinders, a sleeve and a light emitter coupled to the sleeve.

BRIEF SUMMARY OF THE INVENTION

An embodiment of the disclosure meets the needs presented above by generally comprising a walking stick that is elongated for support while walking. A plurality of weighted cylinders is provided and each of the weighted cylinders has a unique weight with respect to each other. Respective ones of the weighted cylinders is attachable to the walking stick to adjust the weight of the walking stick to accommodate a preference of a user. A sleeve is attachable to the walking stick or the weighted cylinder that is attached to the walking stick for gripping. A light emitter is coupled to the sleeve to emit light outwardly therefrom when the light emitter is turned on thereby making the user visible to other individuals.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
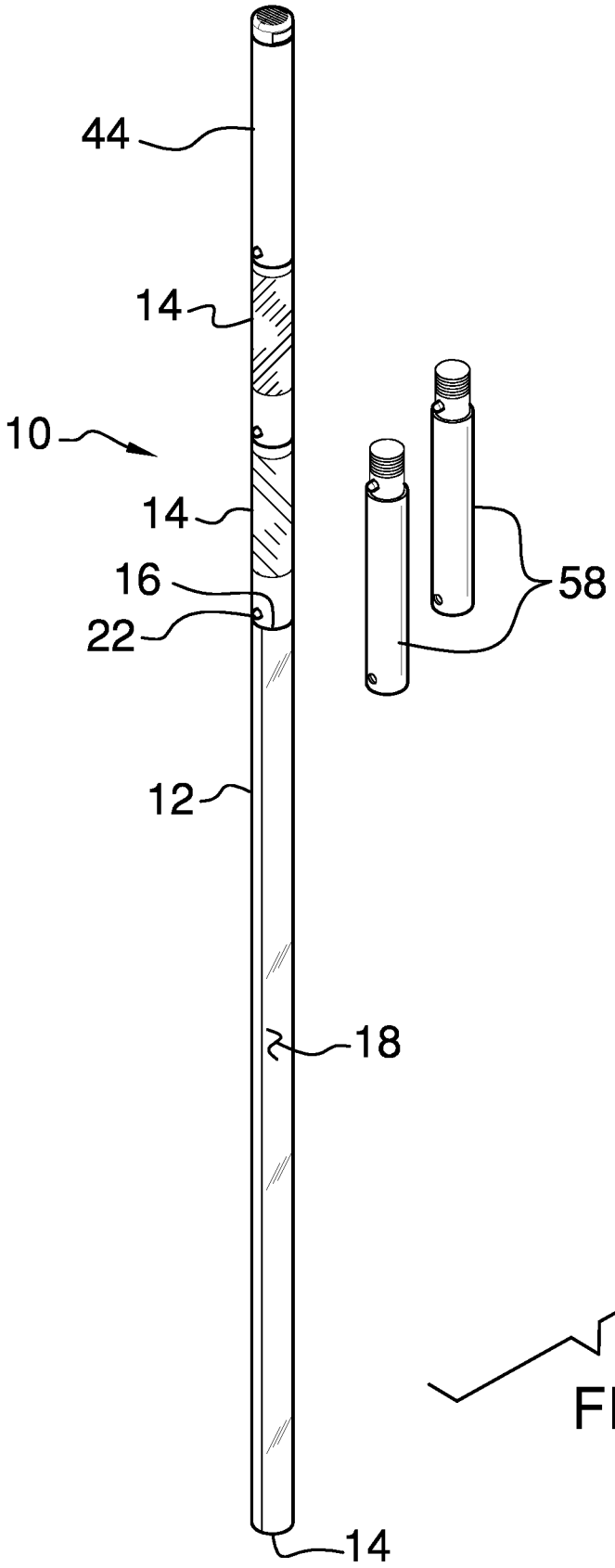
FIG. 1 is a perspective view of a modular walking stick assembly according to an embodiment of the disclosure.
Figure 2:
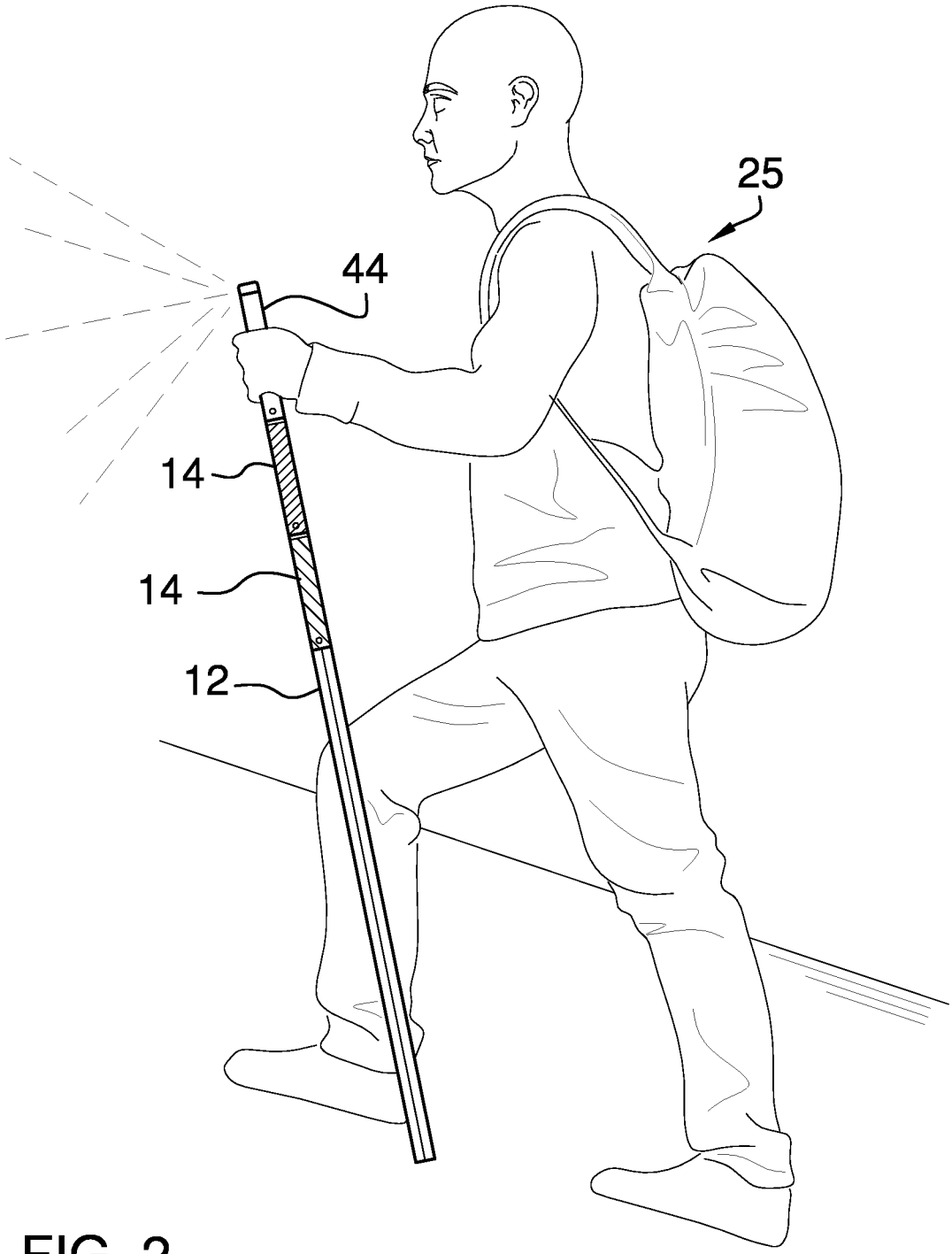
FIG. 2 is a perspective in-use view of an embodiment of the disclosure.
Figure 3:
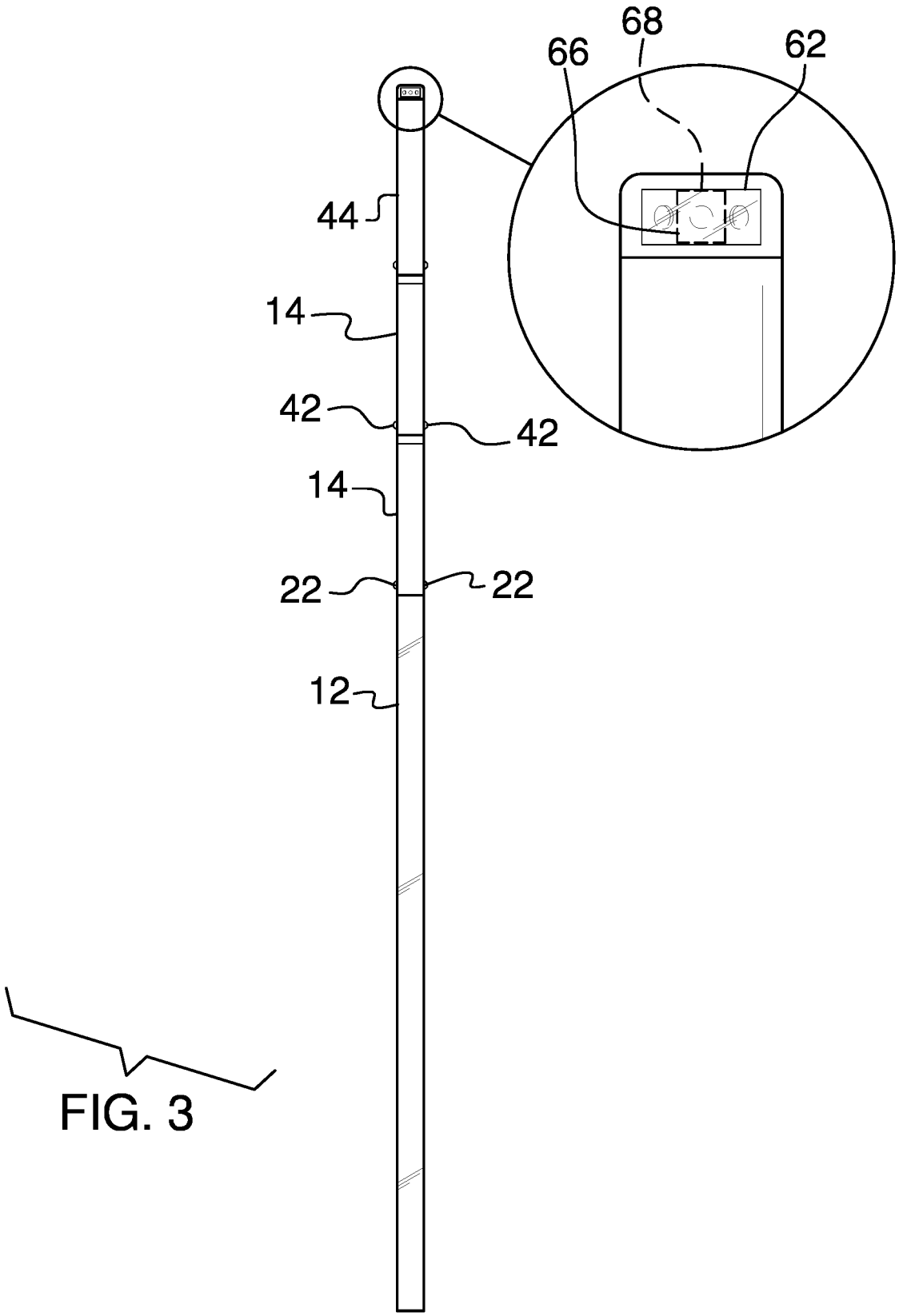
FIG. 3 is a front perspective view of an embodiment of the disclosure.

With reference now to the drawings, and in particular to FIGS. 1 through 5 thereof, a new walking stick device embodying the principles and concepts of an embodiment of the disclosure and generally designated by the reference numeral 10 will be described.

As best illustrated in FIGS. 1 through 5, the modular walking stick assembly 10 generally comprises a walking stick 12 that is elongated to be gripped for support while walking. The walking stick 12 has a bottom end 14, a top end 16 and an outer surface 18 extending therebetween, and the outer surface 18 comprises a light reflecting material to enhance visibility of the walking stick 12 in a darkened environment. The outer surface 18 has a recessed portion 20 extending from the top end 16 toward the bottom end 14, and the recessed portion 20 is threaded.

A pair of first locks 22 is each movably integrated into the walking stick 12 and each of the first locks 22 is positioned on the recessed portion 20 of the outer surface 18. Each of the first locks 22 is biased to extend outwardly from the outer surface 18, and each of the first locks 22 is compressible into the outer surface 18. Each of the first locks 22 may comprise a spring loaded ball or other type of mechanically releasable lock.

A plurality of weighted cylinders 24 is provided and each of the weighted cylinders 24 has a unique weight with respect to each other. Respective ones of the weighted cylinders 24 are attachable to the walking stick 12 for adjusting the weight of the walking stick 12 to accommodate a preference of a user 25. Each of the weighted cylinders 24 has a lower end 26, an upper end 28 and an outside surface 30 extending therebetween, and the lower end 26 of each of the weighted cylinders 24 has a well 32 extending toward the upper end 28. The well 32 in the lower end 26 has a bounding surface 34 and the bounding surface 34 is threaded.

The outside surface 30 of each of the weighted cylinders 24 has a pair of openings 36 extending into the well. The outside surface 30 of each of the weighted cylinders 24 has a recessed portion 38 and the recessed portion 38 of the outside surface 30 is threaded. The recessed portion 20 of the outer surface 18 of the walking stick 12 threadably engages the recessed portion 38 of the outside surface 30 of a respective one of the weighted cylinders 24 for attaching the respective weighted cylinder 24 to the walking stick 12. Each of the first locks 22 on the walking stick 12 engages a respective one of the openings 36 in the outside surface 30 of the respective weighted cylinder 24 for securing the respective weighted cylinder 24 to the walking stick 12. The well 32 in the lower end 26 of a respective one of the weighted cylinders 24 insertably receives the recessed portion 38 of the outside surface 30 of a respective one of the weighted cylinders 24 for stacking the weighted cylinders 24 on the walking stick 12. In this way the weighted cylinders 24 facilitate a maximum weight for the user 25.

Each of the openings 36 associated with a respective one of the weighted cylinders 24 receives a respective one of the first locks 22 when the respective weighted cylinder 24 is attached to the walking stick 12. Each of the weighted cylinders 24 may have a respective weight ranging between approximately 1.0 pound and 2.0 pounds. A plurality of second locks 42 is each movably integrated into a respective one of the weighted cylinders 24. Additionally, the outside surface 30 of each of the weighted cylinders 24 may have a unique color with respect to each other to assist the user 25 with visually identifying the weight of a respective weighted cylinder 24.

Each of the second locks 42 is positioned on the recessed portion 38 of the outside surface 30 of the respective weighted cylinder 24, and each of the second locks 42 is biased to extend outwardly from the outside surface 30. Additionally, each of the second locks 42 is compressible into the outside surface 30. Each of the second locks 42 associated with a respective one of the weighted cylinders 24 engages respective ones of the holes 40 associated with a respective one of the weighted cylinders 24 when the respective weighted cylinders 24 are stacked on each other. Each of the second locks 42 may comprise a spring loaded ball or other type of mechanically releasably lock.

A sleeve 44 is attachable to the walking stick 12 or the weighted cylinder 24 that is attached to the walking stick 12 such that the sleeve 44 can be gripped by the user 25. The sleeve 44 has a lowermost end 46, an uppermost end 48 and an exterior surface 50 extending therebetween, and the lowermost end 46 has a well 52 extending toward the uppermost end 48. The well 52 in the lowermost end 46 has a bounding surface 54, and the bounding surface 54 of the well 52 in the lowermost end 46 is threaded. The exterior surface 50 has a pair of apertures 56 each extending into the well 52 in the lowermost end 46, and the bounding surface 54 of the well 52 in the lowermost end 46 threadably engages the recessed portion 38 of the outside surface 30 of a respective one of the weighted cylinders 24. Moreover, each of the second locks 42 on the respective weighted cylinder 24 engages a respective one of the apertures 56 when the respective weighted cylinder 24 is attached to the sleeve 44.

Figure 4:
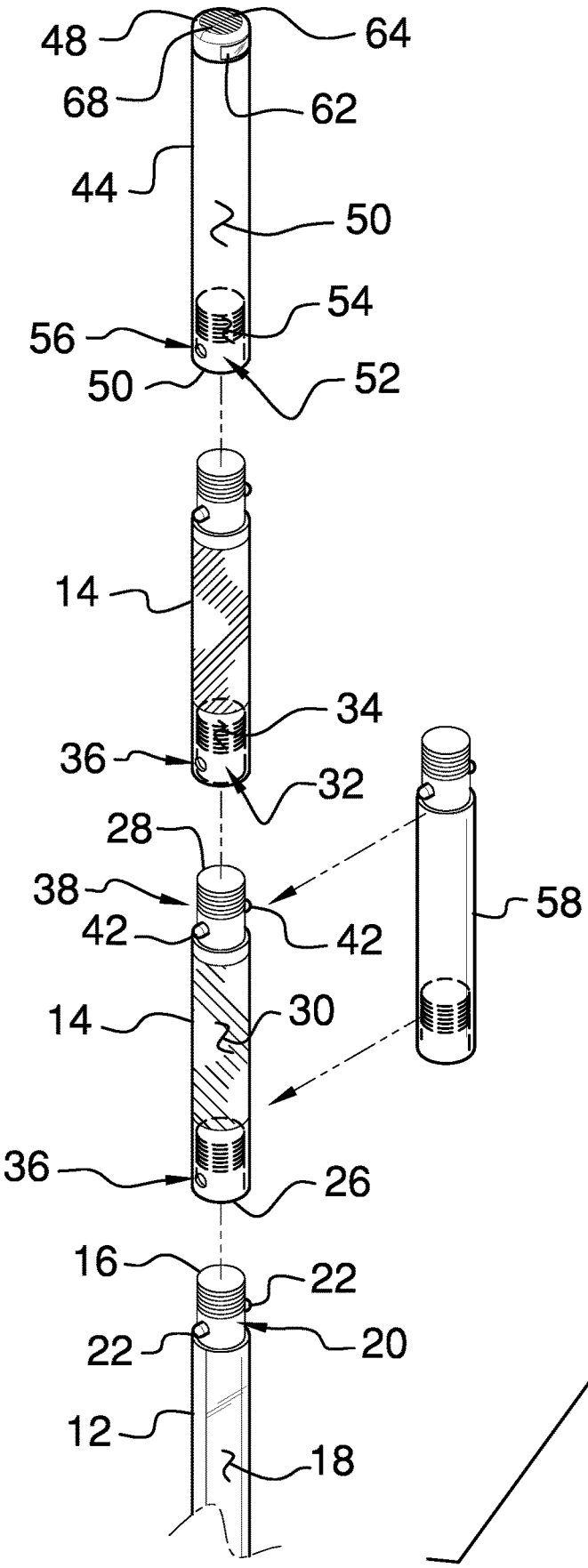
FIG. 4 is an exploded phantom view of an embodiment of the disclosure.
Figure 5:
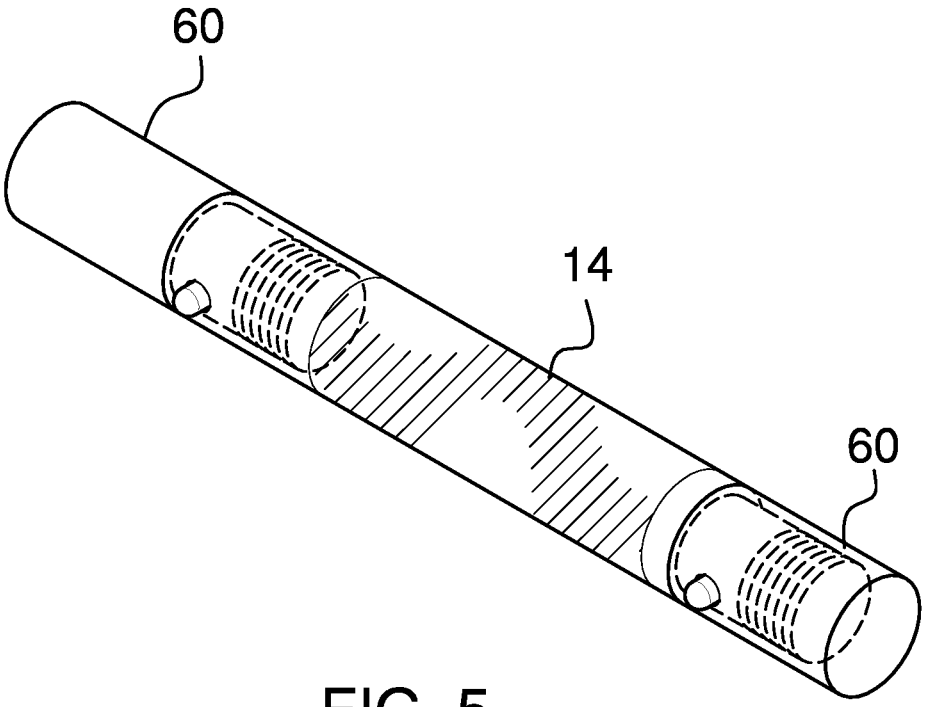
FIG. 5 is a phantom perspective view of a weighted cylinder and a pair of end caps of an embodiment of the disclosure.

As is shown in FIGS. 1 and 4, the plurality of weighted cylinders 24 may include at least one weighted cylinder that has a minimal amount of weight 58. In this way the weighted cylinder with the minimal amount of weight 58 can serve to elongate the overall length of the walking stick 12 without adding a significant amount of weight to the walking stick 12. As is shown in FIG. 5, a plurality of end caps 60 might be provided that can be attached to a respective lower end 26 and upper end 28 of a respective one of the weighted cylinders 24.

A light emitter 62 is coupled to the sleeve 44 to emit light outwardly therefrom when the light emitter 62 is turned on. In this way the light emitter 62 can make the user 25 visible to other individuals in a darkened environment. The light emitter 62 may comprise an LED or other type of electronic light emitter 62. A power supply 64 is integrated into the sleeve 44 and the power supply 64 is electrically coupled to the light emitter 62. The power supply 64 comprises a battery 66 that is integrated into the sleeve 44, and the battery 66 is electrically coupled to the light emitter 62. A solar panel 68 is positioned on the uppermost end 48 of the sleeve 44 such that the solar panel 68 can be exposed to sunlight. The solar panel 68 is electrically coupled to the battery 66 for charging the battery 66.

In use, selected ones of the weighted cylinders 24 can be attached to the walking stick 12, and be stacked on each other, to not only increase the overall weight of the walking stick 12, but also increase the overall length of the walking stick 12. In this way the walking stick 12 can be customized in a variety of ways to accommodate the user's 25 preference. The sleeve 44 can be attached to a topmost one of the weighted cylinders 24, or to the top end 16 of the walking stick 12. Thus, the sleeve 44 is gripped for employing the walking stick 12 for walking or hiking. Additionally, the weighted cylinders 24 facilitate upper body exercise while the walking stick 12 is being employed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A modular walking stick assembly having an adjustable weight for accommodating a user's preference, said assembly comprising:

a walking stick being elongated wherein said walking stick is configured to be gripped for support while walking;

a plurality of weighted cylinders, each of said weighted cylinders having a unique weight with respect to each other, respective ones of said weighted cylinders being attachable to said walking stick wherein said respective weighted cylinders is configured to adjust the weight of said walking stick to accommodate a preference of a user;

a sleeve being attachable to said walking stick or said weighted cylinder that is attached to said walking stick wherein said sleeve is configured to be gripped by the user, a light emitter being coupled to said sleeve wherein said light emitter is configured to emit light outwardly therefrom when said light emitter is turned on thereby making the user visible to other individuals; and wherein each of said weighted cylinders has a lower end, an upper end and an outside surface extending therebetween, said lower end of each of said weighted cylinders having a well extending toward said upper end, said well in said lower end having a bounding surface, said bounding surface being threaded, said outside surface of each of said cylinders having a pair of openings extending into said well, said outside surface of each of said cylinders having a recessed portion, said recessed portion of said outside surface being threaded.

2. The assembly according to claim 1, wherein:

said walking stick has a bottom end, a top end and an outer surface extending therebetween, said outer surface comprising a light reflecting material wherein said outer surface is configured to enhance visibility of said walking stick in a darkened environment, said outer surface having a recessed portion extending from said top end toward said bottom end, said recessed portion being threaded;

said assembly includes a pair of first locks, each of said first locks being movably integrated into said walking stick, each of said first locks being positioned on said recessed portion of said outer surface, each of said first locks being biased to extend outwardly from said outer surface, each of said first locks being compressible into said outer surface;

said recessed portion of said outer surface of said walking stick threadably engages said recessed portion of said outside surfaced of a respective one of said weighted cylinders for attaching said respective weighted cylinder to said walking stick, each of said first locks on said walking stick engaging a respective one of said openings in said outside surface of said respective weighted cylinder for securing said respective weighted cylinder to said walking stick.

3. The assembly according to claim 2, wherein said well in said lower end of a respective one of said weighted cylinders insertably receiving said recessed portion of said outside surface of a respective one of said weighted cylinders for stacking said weighted cylinders on said walking stick wherein said weighted cylinders are configured to facilitate a maximum weight for the user, each of said openings associated with a respective one of said weighted cylinders receiving a respective one of said first locks when said respective weighted cylinder is attached to said walking stick.

4. The assembly according to claim 2, further comprising a plurality of second locks, each of said second locks being movably integrated into a respective one of said weighted cylinders, each of said second locks being positioned on said recessed portion of said outside surface of said respective weighted cylinder, each of said second locks being biased to extend outwardly from said outside surface, each of said second locks being compressible into said outside surface, each of said second locks associated with a respective one of said weighted cylinders engaging respective ones of said openings associated with a respective one of said weighted cylinders when said respective weighted cylinders are stacked on each other.

5. The assembly according to claim 4, wherein said sleeve has a lowermost end, an uppermost end and an exterior surface extending therebetween, said lowermost end having a well extending toward said uppermost end, said well in said lowermost end having a bounding surface, said bounding surface of said well in said lowermost end being threaded, said exterior surface having a pair of apertures each extending into said well in said lowermost end, said bounding surface of said well in said lowermost end threadably engaging said recessed portion of said outside surface of a respective one of said weighted cylinders, each of said second locks on said respective weighted cylinder engaging a respective one of said apertures when said respective weighted cylinder is attached to said sleeve.

6. The assembly according to claim 1, further comprising a power supply being integrated into said sleeve, said power supply being electrically coupled to said light emitter, said power supply comprising:

a battery being integrated into said sleeve, said battery being electrically coupled to said light emitter; and a solar panel being positioned on said uppermost end of said sleeve wherein said solar panel is configured to be exposed to sunlight, said solar panel being electrically coupled to said battery for charging said battery.

7. A modular walking stick assembly having an adjustable weight for accommodating a user's preference, said assembly comprising:

a walking stick being elongated wherein said walking stick is configured to be gripped for support while walking;

a plurality of weighted cylinders, each of said weighted cylinders having a unique weight with respect to each other, respective ones of said weighted cylinders being attachable to said walking stick wherein said respective weighted cylinders is configured to adjust the weight of said walking stick to accommodate a preference of a user;

a sleeve being attachable to said walking stick or said weighted cylinder that is attached to said walking stick wherein said sleeve is configured to be gripped by the user;

a light emitter being coupled to said sleeve wherein said light emitter is configured to emit light outwardly therefrom when said light emitter is turned on thereby making the user visible to other individuals;

wherein said walking stick has a bottom end, a top end and an outer surface extending therebetween, said outer surface comprising a light reflecting material wherein said outer surface is configured to enhance visibility of said walking stick in a darkened environment, said outer surface having a recessed portion extending from said top end toward said bottom end, said recessed portion being threaded; and wherein said assembly includes a pair of first locks, each of said first locks being movably integrated into said walking stick, each of said first locks being positioned on said recessed portion of said outer surface, each of said first locks being biased to extend outwardly from said outer surface, each of said first locks being compressible into said outer surface.

8. A modular walking stick assembly having an adjustable weight for accommodating a user's preference, said assembly comprising:

a walking stick being elongated wherein said walking stick is configured to be gripped for support while walking, said walking stick having a bottom end, a top end and an outer surface extending therebetween, said outer surface comprising a light reflecting material wherein said outer surface is configured to enhance visibility of said walking stick in a darkened environment, said outer surface having a recessed portion extending from said top end toward said bottom end, said recessed portion being threaded;

a pair of first locks, each of said first locks being movably integrated into said walking stick, each of said first locks being positioned on said recessed portion of said outer surface, each of said first locks being biased to extend outwardly from said outer surface, each of said first locks being compressible into said outer surface;

a plurality of weighted cylinders, each of said weighted cylinders having a unique weight with respect to each other, respective ones of said weighted cylinders being attachable to said walking stick wherein said respective weighted cylinders is configured to adjust the weight of said walking stick to accommodate a preference of a user, each of said weighted cylinders having a lower end, an upper end and an outside surface extending therebetween, said lower end of each of said weighted cylinders having a well extending toward said upper end, said well in said lower end having a bounding surface, said bounding surface being threaded, said outside surface of each of said cylinders having a pair of openings extending into said well, said outside surface of each of said cylinders having a recessed portion, said recessed portion of said outside surface being threaded, said recessed portion of said outer surface of said walking stick threadably engaging said recessed portion of said outside surfaced of a respective one of said weighted cylinders for attaching said respective weighted cylinder to said walking stick, each of said first locks on said walking stick engaging a respective one of said openings in said outside surface of said respective weighted cylinder for securing said respective weighted cylinder to said walking stick, said well in said lower end of a respective one of said weighted cylinders insertably receiving said recessed portion of said outside surface of a respective one of said weighted cylinders for stacking said weighted cylinders on said walking stick wherein said weighted cylinders are configured to facilitate a maximum weight for the user, each of said openings associated with a respective one of said weighted cylinders receiving a respective one of said first locks when said respective weighted cylinder is attached to said walking stick;

a plurality of second locks, each of said second locks being movably integrated into a respective one of said weighted cylinders, each of said second locks being positioned on said recessed portion of said outside surface of said respective weighted cylinder, each of said second locks being biased to extend outwardly from said outside surface, each of said second locks being compressible into said outside surface, each of said second locks associated with a respective one of said weighted cylinders engaging respective ones of said holes associated with a respective one of said weighted cylinders when said respective weighted cylinders are stacked on each other;

a sleeve being attachable to said walking stick or said weighted cylinder that is attached to said walking stick wherein said sleeve is configured to be gripped by the user, said sleeve having a lowermost end, an uppermost end and an exterior surface extending therebetween, said lowermost end having a well extending toward said uppermost end, said well in said lowermost end having a bounding surface, said bounding surface of said well in said lowermost end being threaded, said exterior surface having a pair of apertures each extending into said well in said lowermost end, said bounding surface of said well in said lowermost end threadably engaging said recessed portion of said outside surface of a respective one of said weighted cylinders, each of said second locks on said respective weighted cylinder engaging a respective one of said apertures when said respective weighted cylinder is attached to said sleeve;

a light emitter being coupled to said sleeve wherein said light emitter is configured to emit light outwardly therefrom when said light emitter is turned on thereby making the user visible to other individuals; and a power supply being integrated into said sleeve, said power supply being electrically coupled to said light emitter, said power supply comprising:

a battery being integrated into said sleeve, said battery being electrically coupled to said light emitter; and a solar panel being positioned on said uppermost end of said sleeve wherein said solar panel is configured to be exposed to sunlight, said solar panel being electrically coupled to said battery for charging said battery.

* * * * *